United States Patent [19]

Hintze

[11] 4,035,894

[45] July 19, 1977

[54] AIR CONDITIONING APPARATUS AND METHOD FOR MAKING THE SAME, PARTICULARLY FOR AUTOMOTIVE VEHICLES

[76] Inventor: Rudolf Hintze, Lessingstrasse 32, Heusenstamm, Germany

[21] Appl. No.: 605,830

[22] Filed: Aug. 19, 1975

Related U.S. Application Data

[60] Division of Ser. No. 469,441, May 20, 1974, Pat. No. 3,953,985, which is a continuation-in-part of Ser. No. 307,212, Nov. 16, 1972, Pat. No. 3,852,976.

[30] Foreign Application Priority Data

Nov. 19, 1971 Germany ..... 2157380
May 20, 1974 Germany ..... 2325282

[51] Int. Cl.[2] ..... B23P 15/26
[52] U.S. Cl. ..... 29/157.3 R; 29/157.3 D; 62/499
[58] Field of Search ..... 29/157 R, 157.3 D, 157.3 R; 113/118 D; 62/499; 165/153, 152, 125

[56] References Cited

U.S. PATENT DOCUMENTS

| | | | |
|---|---|---|---|
| 1,950,500 | 3/1934 | Loprich et al. | 113/118 D |
| 2,012,582 | 8/1935 | Slagel | 113/118 D |
| 2,244,475 | 6/1941 | Raskin | 113/118 D |
| 3,273,227 | 9/1966 | Pauls | 165/153 |
| 3,347,059 | 10/1967 | Laing | 62/499 |
| R18,182 | 9/1931 | Booth | 29/157.3 D |

*Primary Examiner*—C.W. Lanham
*Assistant Examiner*—Daniel C. Crane
*Attorney, Agent, or Firm*—Michael J. Striker

[57] ABSTRACT

An air conditioning apparatus and method of making the same, particularly for use in automotive vehicles, wherein the condenser and the compressor are assembled into a single aggregate which is rotatably mounted on a stationary crank shaft and is driven by the engine. The condenser has the form of a tubular rotor and is constructed as an assembly which includes a pair of sheet-material members at least one of which has a major surface formed with depressions which constitute channels, whereas the other overlies this major surface and is sealingly connected to the same intermediate respective ones of these channels and along the periphery of the major surface, so as to define with the other sheet-material member a plurality of fluid-flow passages.

6 Claims, 5 Drawing Figures

AIR CONDITIONING APPARATUS AND METHOD FOR MAKING THE SAME, PARTICULARLY FOR AUTOMOTIVE VEHICLES

CROSS-REFERENCE TO RELATED APPLICATION:

This present application is a divisioned application of my allowed prior application 469,441, filed on May 20, 1974, now U.S. Pat. No. 3953,985, which is in turn a continuation-in-part of application Serial No. 307,212, filed on Nov. 16, 1972, now U.S. Pat. No. 3,852,976.

BACKGROUND OF THE INVENTION

This invention relates to air conditioning apparatus in general, and in particular to improvements in air conditioning apparatus wherein a compressor compresses a cooling agent which is thereupon caused to pass into a condenser and from there into an evaporator prior to being returned into the compressor. In particular, the invention relates to improvements in air conditioning apparatus which can be used with particular advantage for conditioning the air in the interior of automotive vehicles.

In my copending allowed applicaton now U.S. Pat. No. 3,852,976, the entire content of which is herein incorporated by reference, I have disclosed an air conditioning apparatus of the general type here in question wherein a stationary support, preferably including a crank shaft, has rotatably mounted on it a rotary compressor device for an evaporable cooling agent. A drive rotates the compressor device, and a condenser device for compressed cooling agent rotates with the compressor device. The crank shaft has a passage receiving cooling agent from the compressor device or from the condenser device for conveying the cooling agent to the expansion valve of an evaporator located in or close to the passenger or driver compartment in an automotive vehicle. The compressor unit comprises a cylinder and a bearing sleeve which is rigid with the cylinder and surrounds the crank shaft and is formed with the passage communicating with the passage of the crank shaft and receiving cooling agent either from the cylinder of the compressor device or from the condenser device. The passage of the bearing sleeve receives cooling agent directly from the cylinder of the compressor device if the latter rotates relative to the condenser device; the passage of the crank shaft then delivers cooling agent to the condenser device and the latter supplies condensed cooling agent to the evaporator which returns vaporized cooling agent to the compressor device. If the compressor device and the condenser device constitute an aggregate which rotates relative to the crank shaft, the compressor device supplies cooling agent directly to the condenser device and the latter supplies condensed cooling agent to the passage of the bearing sleeve for admission into the passage of the crank shaft.

The condensser device in my above-identified invention utilizes one or more tubes which are concentrically wound to form a tubular rotor. The rotor is formed with ribs or fins in form of vanes so as to agitate the surrounding air and provide cooling of the tube convolutions.

This construction is highly advantageous, for the reasons set forth in my aforementioned application. However, I have found that it is possible to make the operation of the device still more effective, and that it is desirable to make the device more economical to construct at the same time, and thus to make the apparatus even more advantageous.

SUMMARY OF THE INVENTION

It is therefore an object of the present invention to provide an improved air conditioning apparatus which possesses the aforementioned advantages, while also having all of the advantages of the air conditioning apparatus disclosed in my earlier-mentioned application.

An additional object, and a more particular one, is to provide such an improved air conditioning apparatus wherein the construction of the condenser device is simplified and made less expensive.

Still a further object of the invention is to provide such an air conditioning apparatus which is of improved effectiveness.

In keeping with the above objects, and with others which will become apparent hereafter, one feature of the invention resides, in an air conditioning apparatus of the type under discussion, in a combination which comprises a stationary support on which a rotary compressor device for an evaporable cooling agent is mounted for rotation. Drive means rotates the compressor device, and a condenser device is provided which is also mounted for rotation with the compressor device and which is adapted to receive compressed cooling agent. According to the invention, the condenser device comprises an assembly including a pair of sheet-material members at least one of which has a major surface provided with depressions which form channels, the other of these members overlying the aforementioned major surface and being sealingly connected to the same intermediate respective ones of the channels and along the periphery of the major surface, so as to define with the first-mentioned member a plurality of fluid-flow passages.

The passages include two parallel passages which are spaced from one another, and transverse passages which connect them and intermediate which the members are sealingly connected. In the portions which are located intermediate the respective transverse passages both members are formed with slots which terminate short of the respective parallel passages, and the assembly composed of the two members is then so deformed that the portions located intermediate consecutive ones of these parallel slots — each of which portions contains one of the transverse passages — are bent out of the general plane of the assembly to form vanes which act as air-guiding vanes when the assembly is subsequently shaped to the form of a tubular rotor. The depressions can be embossed in the one sheet material member, or of course they can be embossed in both of the sheet material members, or can be otherwise formed.

It is evident that an assembly of this type can be produced much more rapidly and at considerably less expense than if a tube or more than one tube must be wound to the configuration of a tubular rotor. Yet, the assembly according to the present invention can make use of the particularly high heat-exchange efficiency that can be obtained with a rotary heat exchanger or condenser, wherein the air to which heat is transferred constantly changes as it comes in contact with the surfaces of the assembly. Each of the blades or vanes formed on the assembly according to the present invenion will leave — as the tubular rotor rotates — a turbulent wake in the path of the other blades so that the heat exchange efficiency of a condenser of this type is a multiple of that of a stationary condenser.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1A:
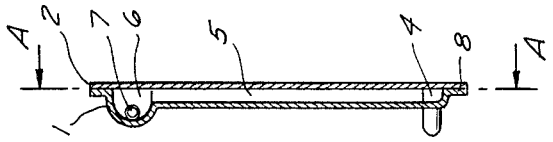
FIG. 1A is a vertical section through an assembly according to the present invention.
Figure 1B:
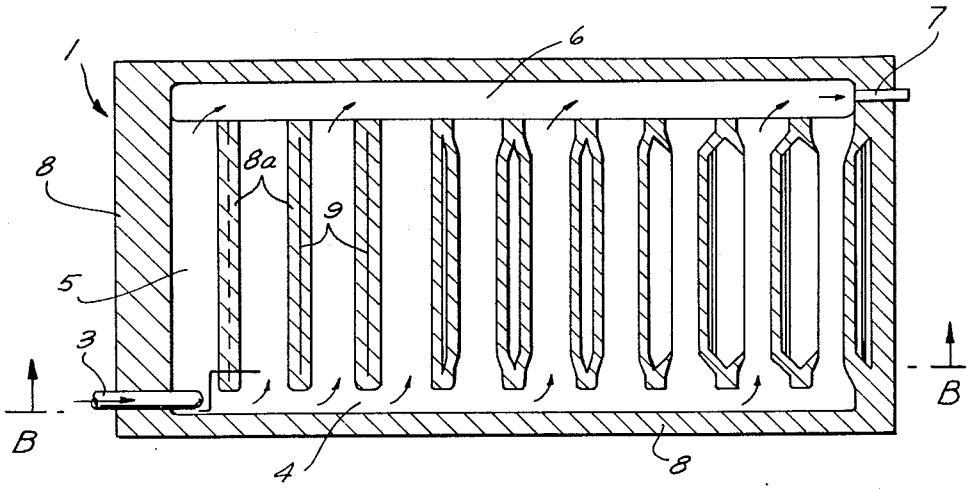
FIG. 1B is a section taken on line A—A of FIG. 1A.

Referring firstly to FIGS. 1A and 1B it will be seen that I have there illustrated an assembly for a condenser device according to the present invention. The assembly is here composed of two sheet metal members 1 and 2 which are essentially plate-shaped. In the illustrated embodiment, the member 2 is completely planar, whereas the member 1 is formed with a plurality of depressions or embossments forming a distribution channel 4 for fluid, a collecting and outlet channel 6, and a plurality of transverse connecting channels 5. The members 1 and 2 are sealingly connected with one another — as by soldering, flow-bonding or the like — along the circumferentially extending periphery 8 and along strip-shaped portions 8*a*. These areas where a gas-tight connection is established are hatched in FIG. 1B, where the member 2 is not visible due to the section on which FIG. 1B is taken. The channel 4 communicates with an inlet conduit 3 through which fluid is admitted, and the channel 6 communicates with an outlet conduit 7 through which fluid leaves. The fluid flows from the channel 4 through the channel 5 into the channel 6. It enters as compressed cooling agent and leaves at 7 as condensate.

Figure 2:
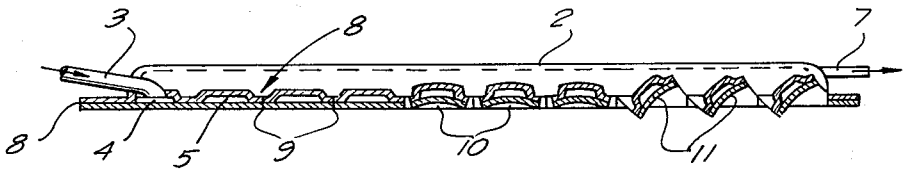
FIG. 2 is a section taken on line B—B of FIG. 1B.
Figure 3:
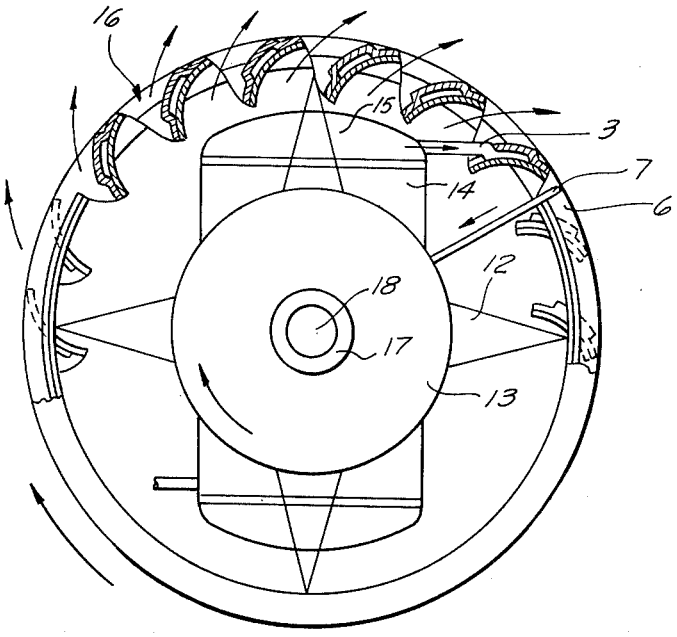
FIG. 3 is a somewhat diagrammatic partly sectioned end view of an air conditioning apparatus embodying the invention but corresponding otherwise to the apparatus disclosed in my aforementioned copending application.

The depressions forming the channels 5 are relatively flat, as seen particularly in FIG. 2. Because the channels 4 and 5 must be capable of handling a greater fluid flow than the individual channels 5, they are more pronouncedly deformed so as to have a larger volume. It is important according to the present invention that when the assembly is finally shaped to the form of a tubular rotor as shown in FIG. 3, the channel 6 should be located on a larger radius of the rotor than the channel 4, in order to assure that the condensate which forms in the connecting channels 5 and which is transported by centrifugal force from the channels 5 into the channel 6, can be properly received in the latter. In order to assure that the channel 6 will be promptly emptied of such condensate, and will not become filled up and thus prevent the inflow of further condensate from the channel 5, the outlet conduit 7 is located at the outside of the finished tubular rotor (compare FIG. 3), that is at the region of largest circumference of the channel 6.

When the members 1 and 2 have been fluid-tightly connected in sealing relationship along the portions 8, 8*a*, slots are formed by stamping or another suitable manner in these portions 8*a*; these slots are identified with reference numeral 9 and extend in the respective portions 8*a* as illustrated, but terminate short of the channels 4 and 6, respectively. After the slots 9 have been formed, the portions 8*a* are deformed progressively until they are finally bent to the arcuate shape shown in FIG. 3, where they each constitute a vane of the rotor, and wherein each of the vanes accommodates one of the channels 5 within it. This involves of course a progressive increasing of the width of the respective slots 9, as is evident from a comparsion of the slots at the left-hand side of FIGS. 1B and 2, with the slots located farther to the right in the two Figures. This progressive increasing of the width of the slots 9 results in the formation of air spaces 16 (FIG. 3) between the adjacent vanes thus formed, so that the thus-produced vanes or fins 11 (FIG. 2) now act to guide the cooling air.

When the rotor is thus formed, it is mounted by means of supports 12 (located at or near the respective axial ends of the rotor) on the tubular compressor support 13, together with the compressor 14. Thus, the rotor which constitutes the condenser device and the compressor 14 rotate together with the supporting tube 13, which latter in turn can be driven in the direction of the arrow in FIG. 3 via a tubular driven shaft 17 that is connected with the tube 13 and which is mounted on the stationary supporting shaft 18. These details have been illustrated only diagrammatically, because they are fully disclosed in my aforementioned allowed copending application and are not essential to an understanding of the present invention which resides in the fact that the condenser device is constructed as disclosed herein.

Figure 4:
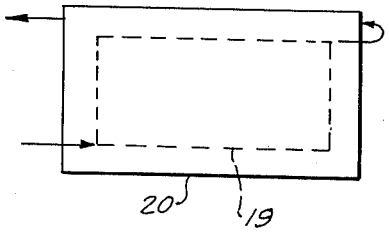
FIG. 4 is a strictly diagrammatic view illustrating a further embodiment of the invention.

FIG. 4 shows in strictly diagrammatic form a further embodiment of the invention, and it will be seen that a smaller-diameter tubular rotor 19 of the type discussed above may be nested within a larger-diameter similar tubular rotor 20 for rotation with the same. The fluid flow is indicated by the arrows in FIG. 4, and the fluid may first be admitted into the rotor 19, and pass from the outlet thereof into the inlet of the rotor 20 to be discharged from the latter. Of course, the direction of fluid flow can be reversed, and it is equally evident that more than two such nested- together tubular rotors could be employed, with their inlets and outlets for the fluid being appropriately connected. It is advantageous if the single or several inner ones of the rotors in this case are constructed without the collecting channel 6, but this is not absolutely necessary. It will also be clear that the formation of the channels 4, 5 and 6 can be carried out according to any known material-shaping method, that is by pressing, stamping or the like, and that the illustrated shapes of these channels can be varied within a wide range of possibilities without departing from the intent and concept of the invention.

It will be understood that each of the elements described above, or two or more together, may also find a useful application in other types of constructions differing from the types described above.

While the invention has been illustrated and described as embodied in an air conditioning apparatus, it is not intended to be limited to the details shown, since various modifications and structural changes may be made without departing in any way from the spirit of the present invention.

Without further analysis, the foregoing will so fully reveal the gist of the present invention that-others can be applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A method of making an air conditioning apparatus, particularly for automotive vehicles, comprising the steps of providing a support having an axis of rotation; mounting on the support a compressor device for rotation about said axis; making an annular condenser device, including the step of forming a major surface of one of a pair of sheet-material members with channel-shaped depressions having a pair of transversely-spaced substantially parallel channels and also having a plurality of connecting channels which extend from one to the other of said parallel channels, the step of juxtaposing said pair of sheet-material members so as to define with one another a plurality of fluid-flow passages in which compressed cooling agent is received, and the step of bonding a major surface of the other of said sheet-material members with the major surface of said one sheet-material member in fluid-tight relationship to one another and in surface-to-surface contact intermediate said depressions, said bonding step including sealingly connecting strip-shaped portions of said members which are located between successive ones of said connecting channels with one another; and mounting said condenser device circumambiently about said compressor device on said support for joint rotation with said compressor device.

2. A method as defined in claim 1, wherein the step of bonding comprises flow-bonding said major surfaces with one another.

3. A method as defined in claim 1, wherein the step of bonding comprises pressure-welding said major surfaces with one another.

4. A method as defined in claim 1, wherein said step of bonding further comprises bonding said major surfaces fluid-tightly to one another in surface-to-surface contact along the periphery of said major surfaces.

5. A method as defined in claim 1; and further comprising the step of forming elongated slots intermediate and in substantial parallelism with said respective connecting channels.

6. A method as defined in claim 5; and further comprising the step of deforming said sheet-material members so that the portions located intermediate consecutive ones of said channels are bent out of the general plane of the assembly of said sheet-material members and form air-guiding vanes to guide ambient cooling air.

* * * * *